US009987664B1

(12) United States Patent
Garabedian et al.

(10) Patent No.: US 9,987,664 B1
(45) Date of Patent: Jun. 5, 2018

(54) ITEM SIZE GRADER

(71) Applicant: Garabedian Bros., Inc., Fresno, CA (US)

(72) Inventors: Michael Garabedian, Fresno, CA (US); Michael Emerzian, Fresno, CA (US)

(73) Assignee: GARABEDIAN BROS., INC., Fresno, CA (US)

( * ) Notice: Subject to any disclaimer, the term of this patent is extended or adjusted under 35 U.S.C. 154(b) by 0 days. days.

(21) Appl. No.: 15/591,562

(22) Filed: May 10, 2017

(51) Int. Cl.
*B07C 5/12* (2006.01)
*B07B 1/46* (2006.01)
*B07B 1/36* (2006.01)

(52) U.S. Cl.
CPC ..... *B07B 1/469* (2013.01); *B07B 1/36* (2013.01); *B07B 1/4618* (2013.01)

(58) Field of Classification Search
CPC ..... B07B 1/36; B07B 1/46; B07B 1/4618; B07B 1/469
USPC ..... 209/659, 660, 674, 675, 680
See application file for complete search history.

(56) References Cited

U.S. PATENT DOCUMENTS

| | | | | | |
|---|---|---|---|---|---|
| 2,469,943 | A * | 5/1949 | Axell | B02B 3/04 | 209/288 |
| 3,108,950 | A * | 10/1963 | Buckley | B03B 4/02 | 209/20 |
| 3,701,418 | A * | 10/1972 | Chapman | B07B 13/04 | 209/674 |
| 3,926,793 | A * | 12/1975 | Wise | B03B 5/02 | 209/170 |
| 4,254,878 | A * | 3/1981 | Marsh | B03B 9/06 | 209/288 |
| 5,137,621 | A * | 8/1992 | Brown | B07B 1/15 | 209/234 |
| 7,980,393 | B2 * | 7/2011 | Fennekotter | B07B 1/46 | 209/317 |
| 2012/0024763 | A1 * | 2/2012 | Gindele | B07B 1/4618 | 209/235 |
| 2012/0175288 | A1 * | 7/2012 | Unland | B07B 1/4609 | 209/255 |

* cited by examiner

*Primary Examiner* — Terrell H Matthews
(74) *Attorney, Agent, or Firm* — Kilpatrick Townsend & Stockton LLP

(57) ABSTRACT

A grade sorting system and method. The grade sorting system is designed to sort items of various size grades into bins or other containers having items of similar size grades.

19 Claims, 4 Drawing Sheets

ITEM SIZE GRADER

BACKGROUND

Size graders are used in the food industry for sorting a large number of food items, such as fruits or nuts, into various sizes. As examples, batches of shelled almonds, unshelled pistachios, raisins, and other foods may be sorted via size graders into bins holding items of similar sizes.

In the almond industry, a vibratory conveyor is vibrated or oscillated to convey shelled almonds down and along the length of the deck. The deck includes openings or holes sized to receive particular size product. There may be progressively larger holes down the deck, so that the smallest almonds fall through the first holes, the next size almonds fall through the next sets of holes, and so forth. Generally, larger grade almonds vibrate over and convey past the openings, and almonds of the particular opening size or smaller fall through the openings. The sorted almonds may then be further separated by vibratory decks having openings of different sizes. Thus, a size grader includes one or more vibratory decks having several different size round hole screens. As the almonds travel along the one or more decks, the almonds fall through the round holes separating them into various sizes. Although such round hole screens work well for their intended purpose, slow speeds and low volume through-puts must be used to allow the product to be properly directed to and fall through the proper size hole to be sorted into the appropriate size grades.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to a food grader, such as an almond grader, having a vibratory deck with openings sized for sorting a grade of the food. The vibratory deck defines a top plane and is used to convey the food down the slant of the deck. The openings each include a leading edge on an upstream edge of the opening. An indentation is included for each opening, with the indentation having a ramp that extends from a top plane of the deck downward to where the ramp meets the leading edge of the respective opening. Thus, the leading edge of the opening, defined by the bottom edge of the ramp, is well below the top plane of the deck.

The indentation can be stamped into the deck, and may be formed so that the indentation increases in width until the indentation reaches the leading edge of the hole/opening. In embodiments, the ramp on the indentation leads from the top plane of the deck, at a constant taper, to the leading edge of the opening. The sides of the indentation can be tapered as well so that a cross section of the ramp is rounded with a trough formed at a middle of the ramp.

The indentation directs food toward the openings as the food is conveyed down the deck. The ramp permits the food to more easily enter the opening, and the indentation captures and orientates the food as it is conveyed and directs the food to the opening. Thus, the indentation increases the likelihood that food will fall through the opening. The efficiency of size grading is thus significantly increased with less food being missed on the size grading.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments herein are directed to a grade sorting system and method. The grade sorting system is designed to sort items of various size grades into bins or other containers having items of similar size grades. Embodiments may be utilized with foodstuffs or other items. As examples, the sorting system can be used to sort nuts, such as shelled almonds or unshelled pistachios. In addition, raisins and other foodstuffs may be sorted using the systems and methods described herein.

Figure 1:
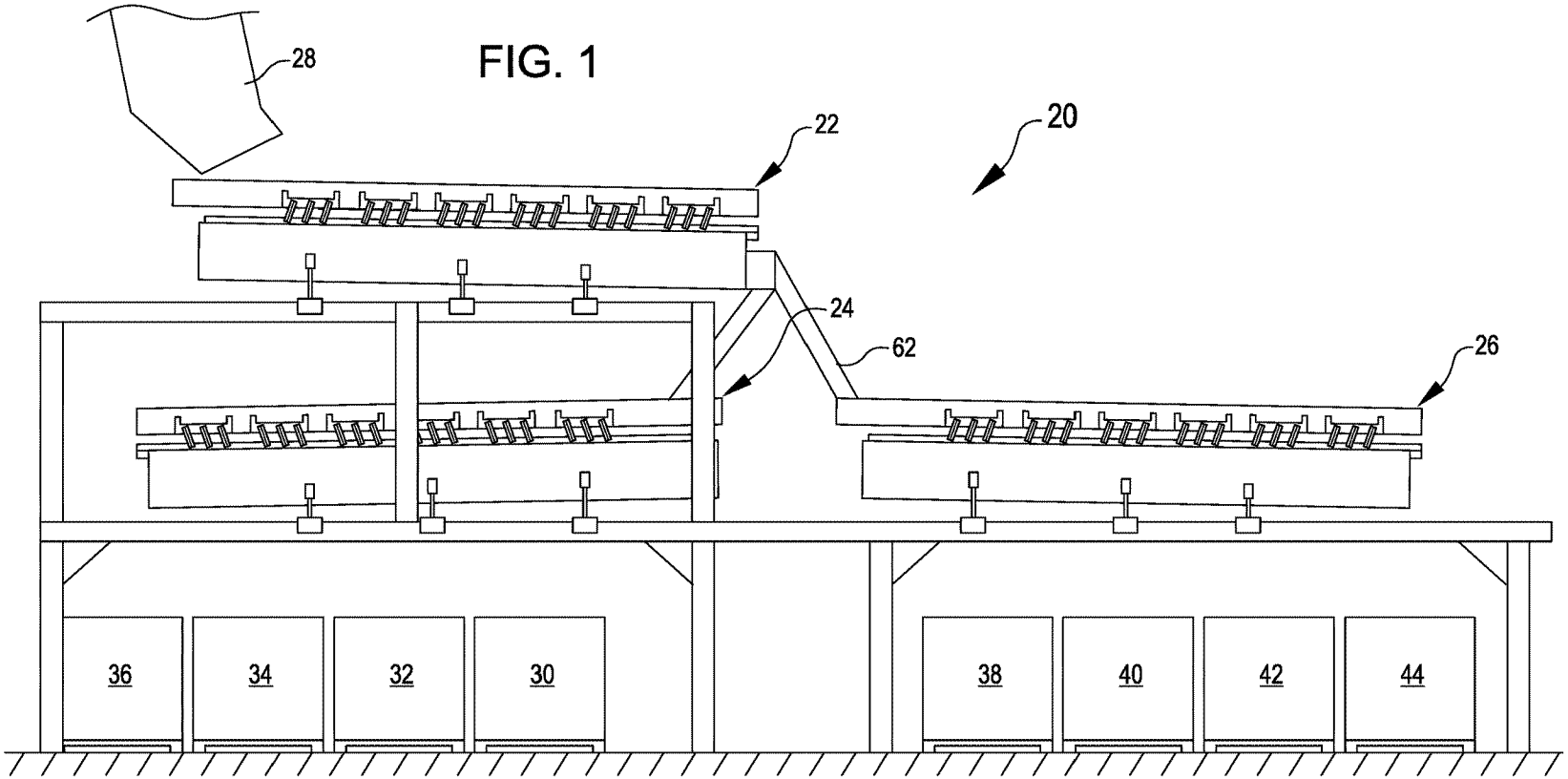
FIG. 1 is a side view of a grader sorter system in accordance with embodiments.

Turning now to FIG. 1, a grade sorting system 20 in accordance with the embodiments is shown. For ease of reference, in the following description, the grade sorting system 20 is defined with respect to sorting almonds, but features of the grade sorting systems described herein can be sized and modified to sort other foodstuffs or items. The sorting system 20 shown in includes an upper vibratory conveyor 22 and two lower vibratory conveyors 24, 26. Although three vibratory conveyors are shown for use with the grade sorting system 20, one or two conveyors, or more than three conveyors can be used in a system. The vibratory conveyors in a system can be used to divide almonds having multiple sizes, or grades, into two or more sets of almonds, for example two sets, with one set being grades 1-4, and a second set with grades 5-8.

A hopper 28 provides items to be sorted, such as almonds, onto the upper vibratory conveyor 22. The vibratory conveyor 22 sorts the items into two sets, with smaller and lower sized grades as a first set, and larger and higher grade sizes as a second set. The upper vibratory conveyor 22 is vibrated so that the foodstuff conveys down its surface. As it is conveyed, it is sorted into the two different grade sets.

The first grade set is directed to the first lower vibratory conveyor 24. The first lower vibratory conveyor 24 sorts the almonds into four bins 30, 32, 34, and 36. The second group is directed to the second lower vibratory conveyor 26, which sorts the second set into four bins 38, 40, 42, and 44.

Figure 2:
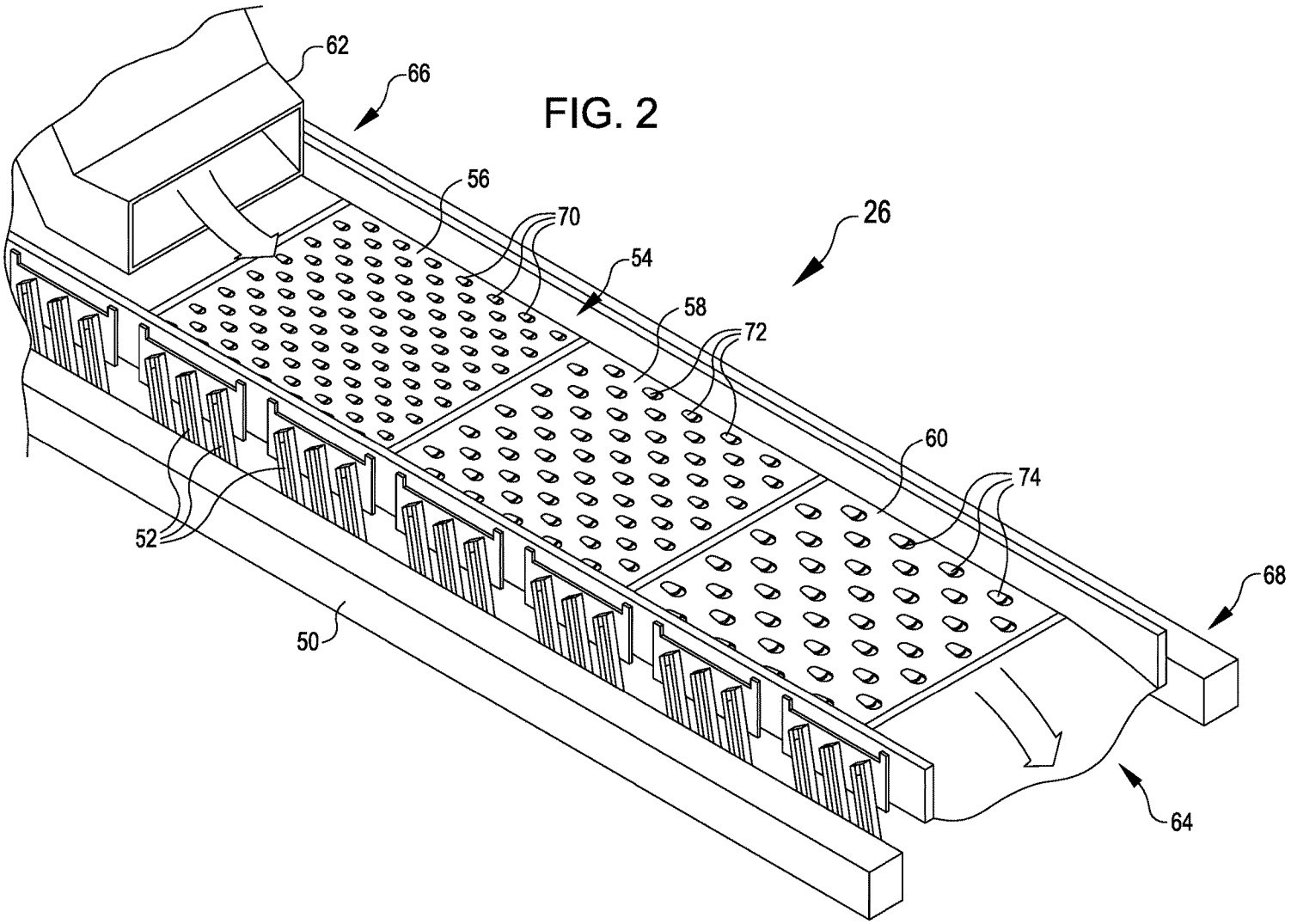
FIG. 2 is a top perspective view of a vibratory conveyor of the grader sorter system of FIG. 1 in accordance with embodiments.

FIG. 2 shows an upper isometric view of the lower vibratory conveyor 26. In general, the vibratory conveyors, such as the vibratory conveyor 26, include a base 50. The base 50 is connected by some structure, in the embodiments shown in FIG. 2, vibrating arms 52, to a conveying deck 54.

The conveying deck 54 includes screens 56, 58, 60 positioned progressively downstream from a discharge chute 62 that comes from the upper vibratory conveyor 22. A chute 64 is positioned at the end of the conveyor. In general, the screens 56, 58, 60, and the chute 64 are positioned so that they feed foodstuff into the bins 38, 40, 42, and 44, respectively. That is, screen 56 feeds almonds into bin 38, screen 58 into bin 40, screen 60 into bin 42, and the chute 64 feeds into the bin 44. To this end, the screens 56, 58, 60 include openings 70, 72, and 78, which are progressively bigger in size. Thus, the smallest foodstuff falls through the openings 70 of the screen 56 and into the bin 38. The next grade up falls through the openings 72 in the screen 58 and into the bin 40. The next larger size or grade falls through the openings 74 of the screen 70 into the bin 42. Foodstuff that is not sorted in this manner falls off the end chute 74 into the bin 44. In this manner, the vibratory conveyor 22 sorts almonds into four grades.

To aid in conveying the foodstuff, as previously described, the vibratory conveyor 24 includes a vibrator that oscillates or vibrates the conveying deck 54 at a rapid rate. In addition, the vibratory conveyor 26 is sloped from an upstream end 66 adjacent to the discharge chute 62 to a downstream end 68 adjacent to the end chute 64. In embodiments, the vibratory conveyor can be tilted so as to allow upstream or downstream direction of flow for the items on the deck. In this manner, the items are moved back and forth over openings so as to increase the likelihood of proper sorting. Thus, as used herein, "downstream" is a direction of travel towards which the vibratory conveyor can urge the items to convey, but not necessarily the only direction.

Figure 3:
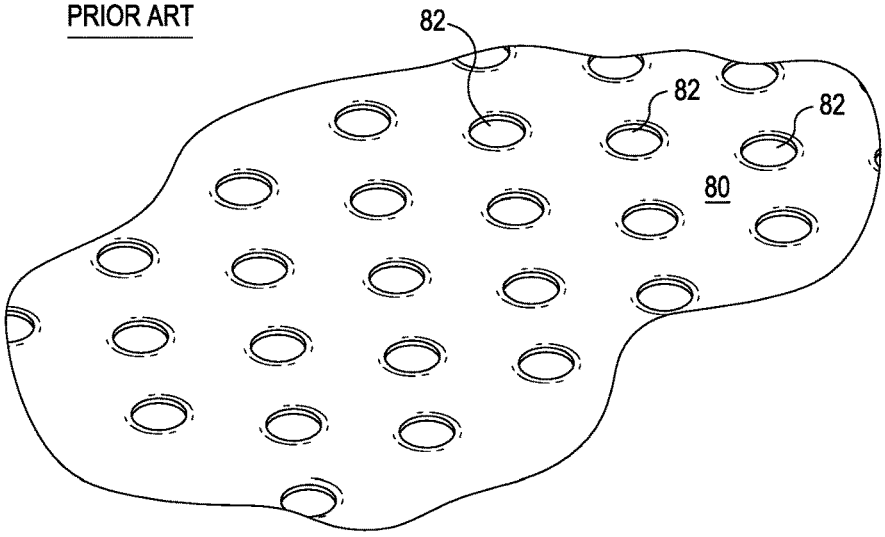
FIG. 3 PRIOR ART
FIG. 3 is a top perspective view of a prior art screen for a deck of an almond grader vibratory conveyor.

FIG. 3 shows a prior art screen 80 utilized in a system similar to the sorting system 20. For this prior art screen 80, a plurality of openings 82 are distributed along the surface. These openings are circular openings and are distributed for allowing a particular size grade of almond to fall through into the respective bin. Although these round openings work well for their intended purpose, often the grade that is desired to be sorted will vibrate and convey over the openings. This is particularly true where a batch of almonds includes a large number of almonds of a single size. With such batches, the grade having the most almonds may skip the appropriate openings and/or the conveying speed must be slowed to allow maximal sorting.

Figure 4:
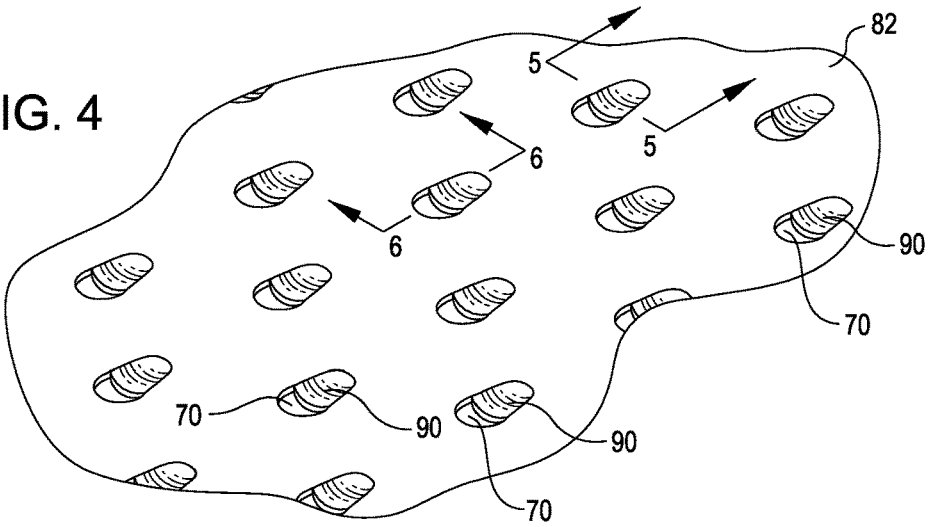
FIG. 4 is a top perspective view of a screen for the deck of the vibratory conveyor of FIG. 2 in accordance with embodiments.
Figure 5:
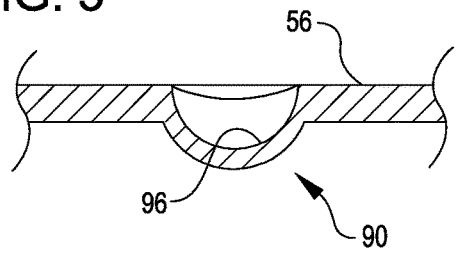
FIG. 5 is a section view of the deck of FIG. 4 taken along the section lines 5-5 of FIG. 4.
Figure 6:
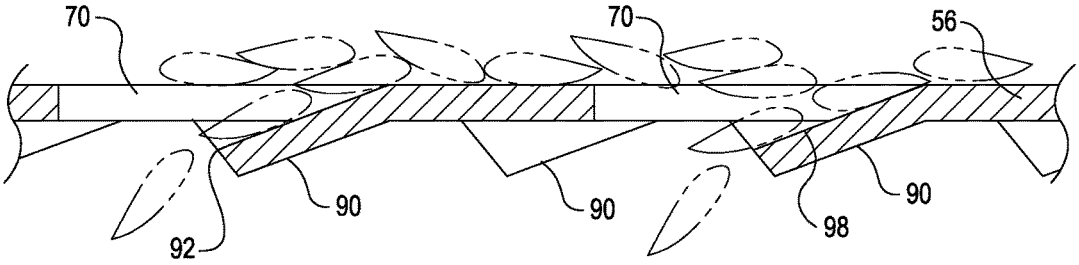
FIG. 6 is a section view of the deck of FIG. 4 taken along the section lines 6-6 of FIG. 4.

In accordance with embodiments, decks are provided with different openings to enhance the sorting of grades of foodstuff such as almonds. FIG. 4 is a detailed view showing some of the openings 70 in the screen 56. FIGS. 5 and 6 are cutaway views of the openings to show further detail.

As can be seen in the drawings, the openings 70 include an indentation at a leading edge of the opening. That is, at an upstream side of the opening. The indentation 90 extends from the leading edge 92 of the opening 70 at a gradual taper upward to the upper surface of the deck 56. As can be seen in FIG. 5, a cross-section of the indentation creates a trough 96 for receiving and directing foodstuff toward the opening 70. As can be seen in FIG. 6, the indentation includes a ramp 98 that further directs the foodstuff downward and toward the opening 70. In general, the indentation provide an advantage over prior art openings in a screen of a deck in that the indentation directs and orientates almonds into the openings. In this manner, more accurate grading can occur, and grading can occur at faster rates.

The leading edge of the opening is defined by the end of the ramp. The end of the ramp 98 is positioned such that a top edge of the leading edge of the opening is below a top plane of the deck. In embodiments, the top edge of the leading edge of the opening is below a bottom plane of the deck. This relationship can be seen in FIG. 6. This relationship allows for the foodstuff to be easily directed to and fall into the opening as the foodstuff is conveyed along the screen 56.

In embodiments, the indentations can be stamped into the screen 56. The ramp and the trough can be arranged so that the indentation increases in width from the top plane of the deck to the leading edge of the opening. This increase in width may be linear or could be configured as desired, but ideally is shaped to funnel, orientate, and direct foodstuff into the openings.

The openings 70, or any of the openings for the screens described herein, can be spaced as desired. Ideally, they are positioned closely together with indentations being close to adjacent openings so that maximum sorting of the appropriate size grade occurs as the foodstuff is conveyed along the conveying surface of the respective vibratory conveyor.

The taper and positioning of the ramp 98 allows alignment of foodstuff, such as nuts, with the openings 70. By orienting and guiding the foodstuff into the openings, throughput in a sorting system such as the sorting system 20 can increase relative to prior art sorting systems utilizing round hole openings 82 as described with respect to the prior art screen 80 in FIG. 3.

The sorting system 20 has been found to be a much more effective sorter of foodstuff, such as almonds. In a specific example, almonds have been sorted with the sorting system 20 at a much higher throughput. For some varieties of almonds and other nuts, there is a high percentage of a certain size of almonds. For these, under the prior art system utilized in the screen shown in FIG. 3, the throughput of the sorting system 20 had to be slowed as the almonds pass over the screen representing the high percentage grade. By utilizing the openings with indentations described herein, nuts can be sorted 55% faster than when using the prior art screens shown in FIG. 3. Specifically, a prior art almond grade sorting system typically runs at 40,000 pounds per hour. These prior art systems would have to slow down to 22,000 to 24,000 pounds per hour when a large number of almonds of a particular grade were present in the nuts being sorted. The new screens, with the indentations and openings, allow the system to operate at 36,000 pounds per hour for these nut mixtures having a high percentage of a single grade. This represents a roughly 55% increase in speed over the previous 22,000 to 24,000 pounds per hour speed.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A size grade sorting system, comprising:

a deck with openings sized for sorting a grade of item, the deck defining a top plane that is slanted from an upstream end to a downstream end;

a vibrator connected to the deck so that operation of the vibrator shakes the deck to convey the item on the deck in a direction from the upstream end toward the downstream end;

openings in the deck, each opening comprising:

a leading edge towards the upstream side of the deck; and an indentation having a ramp that extends from the top plane of the deck to the leading edge of the respective opening, wherein a cross section of the ramp is rounded so that a trough is formed down a middle portion of the ramp.

2. The grade sorting system of claim 1, wherein for each opening, a top edge of the leading edge of the opening is below the top plane of the deck.

3. The grade sorting system of claim 1, wherein for each opening, a top edge of the leading edge of the opening is below the bottom plane of the deck.

4. The grade sorting system of claim 1, wherein for each opening, the indentation is stamped into the deck.

5. The grade sorting system of claim 1, wherein for each opening, the indentation increases in width from the top plane of the deck to the leading edge.

6. The grade sorting system of claim 1, wherein the item is almonds.

7. The grade sorting system of claim 1, wherein for each opening, the ramp tapers linearly from the top plane to the leading edge of the opening.

8. The grade sorting system of claim 1, wherein the openings are spaced apart a distance that is greater than a diameter of the openings.

9. The grade sorting system of claim 1, wherein for each opening, the ramp extends directly towards the upstream side of the deck from the opening.

10. A method of sorting grades of foodstuff, comprising:

accessing a deck comprising a plurality of sets of openings, each set sized for sorting a different grade of food, the deck defining a top plane that is slanted from an upstream end to a downstream end, each opening comprising:

a leading edge towards the upstream side of the deck;

an indentation having a ramp that extends from the top plane of the deck to the leading edge of the respective opening; and a trailing edge towards the downstream side of the deck and at an opposite end of the opening from the ramp, the trailing edge spaced apart from the leading edge in a horizontal direction parallel to the top plane so as to form a through-hole;

depositing a batch of foodstuff onto the deck, the batch including a plurality of grades of the food stuff; and vibrating the deck so as to convey the foodstuff on the deck in a direction from the upstream end toward the downstream end and so that the foodstuff is sorted into grades via the plurality of openings.

11. A screen for a deck of a grade sorting system, the grade sorting system comprising a deck configured for sorting a grade of item, the deck defining a top plane that is slanted from an upstream end to a downstream end, and a vibrator connected to the deck so that operation of the vibrator shakes the deck to convey items on the deck in a direction from the upstream end toward the downstream end, the screen forming at least a portion of the deck and comprising:

a plurality of openings for receiving a grade of items, each opening comprising:

a leading edge towards the upstream side of the deck;

an indentation having a ramp that extends from the top plane of the deck to the leading edge of the respective opening; and a through-hole at the leading edge of the opening, the through-hole extending through the screen in a vertical direction perpendicular to the top plane such that the leading edge is spaced apart from a trailing edge of the opening in a horizontal direction parallel to the top plane.

12. The screen of claim 11, wherein for each opening, a top edge of the leading edge of the opening is below a top plane of the screen.

13. The screen of claim 11, wherein for each opening, a top edge of the leading edge of the opening is below the bottom plane of the screen.

14. The screen of claim 11, wherein for each opening, the indentation is stamped into the screen.

15. The screen of claim 11, wherein for each opening, the indentation increases in width from the top plane of the screen to the leading edge.

16. The screen of claim 11, wherein the item is almonds.

17. The screen of claim 11, wherein for each opening, the ramp tapers linearly from the top plane to the leading edge of the opening.

18. The screen of claim 11, wherein for each opening, a cross section of the ramp is rounded so that a trough is formed down a middle portion of the ramp.

19. The screen of claim 11, wherein for each opening, the ramp extends directly towards the upstream side of the deck from the opening.

* * * * *